United States Patent [19]

Mize

[11] 4,284,203

[45] Aug. 18, 1981

[54] STORAGE BIN CLOSURE WITH LIQUID SEAL

[75] Inventor: Erbie G. Mize, Chattanooga, Tenn.

[73] Assignee: Astec Industries, Inc., Chattanooga, Tenn.

[21] Appl. No.: 93,748

[22] Filed: Nov. 13, 1979

[51] Int. Cl.[3] ..... B65D 43/20; B65D 43/26; B65D 53/06

[52] U.S. Cl. ..... 220/345; 220/228; 220/260; 220/346

[58] Field of Search ..... 220/260, 228, 345, 346, 220/347, 348, 349

[56] References Cited

U.S. PATENT DOCUMENTS

| | | | |
|---|---|---|---|
| 808,320 | 12/1905 | Valerius | 220/228 |
| 1,554,773 | 9/1925 | Wiggins | 220/228 |
| 2,995,505 | 8/1961 | Guild | 220/228 |
| 3,946,772 | 3/1976 | Mize . | |

*Primary Examiner*—George E. Lowrance
*Attorney, Agent, or Firm*—Jones, Thomas & Askew

[57] ABSTRACT

Closure apparatus for the opening in the top of a storage bin or the like, including means for providing a liquid seal between the inside of the storage bin and the outside atmosphere. The apparatus includes a reservoir surrounding the opening in the storage bin and a movable gate structure including a downwardly extending wall that is lowered into the reservoir when the gate structure is moved into a closed position.

2 Claims, 6 Drawing Figures

STORAGE BIN CLOSURE WITH LIQUID SEAL

TECHNICAL FIELD

The present invention relates generally to closure gate apparatus, and more particularly to a closure gate for an opening in the top of a storage bin, the closure including a liquid seal.

BACKGROUND ART

In storage bins for fluent material, it is often desirable or necessary to provide air tight seals at the input and discharge openings of such storage bins. For example, immediately following the manufacture of asphalt aggregate material used for paving, the material is typically placed in large storage bins known as surge bins, from which the material can be dispersed into trucks to be transported from the manufacturing plant to the job site where the material will be used. It is well known that hot asphalt aggregate mix oxidizes and deteriorates when exposed to the air, and therefore storage bins for asphalt aggregate material are provided with air tight openings and are often filled with an inert atmosphere.

In the prior art, sealing means have been provided in connection with gate apparatus to close the input and discharge openings of storage bins. Such sealing means have included conventional gaskets, inflatable gaskets, and liquid sealing means. An apparatus including a discharge gate capable of providing a liquid seal is shown in U.S. Pat. No. 3,949,907. None of such prior art devices have provided a liquid seal for the input opening in the top of a storage bin.

SUMMARY OF THE INVENTION

The present invention provides a novel top gate closure for a storage bin including a means for providing a liquid seal of the top gate closure.

Generally described, the invention provides a closure for an opening in the top of a storage bin, comprising a reservoir surrounding the opening in the top of the bin and containing a liquid, a movable sealing gate including a downwardly extending wall shaped to be received within the reservoir, and a means for selectively moving the sealing gate between a first position laterally removed from the reservoir and a second position wherein the downwardly extending wall of the sealing gate extends into the liquid in the reservoir to form a continuous liquid seal between the sealing gate and the top of the storage bin.

The means for moving the sealing gate can comprise a pair of parallel tracks on opposite sides of the reservoir, the tracks supporting the sealing gate and defining a path between the first and second positions of the sealing gate, and a means for selectively moving the sealing gate along the tracks between the first and second positions. A material guide chute can be commonly mounted with the sealing gate for movement along the tracks, the chute being aligned over the opening in the top of the storage bin when the sealing gate is in the first position, that is, laterally displaced away from the opening.

Thus, it is an object of the present invention to provide an improved sealing gate closure for an opening in the top of a storage bin.

It is a further object of the present invention to provide a sealing gate closure for an opening in the top of a storage bin including a liquid seal for preventing the passage of air when the gate is in a closed position.

It is a further object of the present invention to provide a top gate closure for a storage bin including both a means for providing a liquid seal when the gate is in a closed position, and a chute for guiding material into the storage bin when the gate is in an open position.

Other objects, features and advantages of the present invention will become apparent upon examination of the following specification, when taken in conjunction with the accompanying drawing.

DETAILED DESCRIPTION

Figure 1:
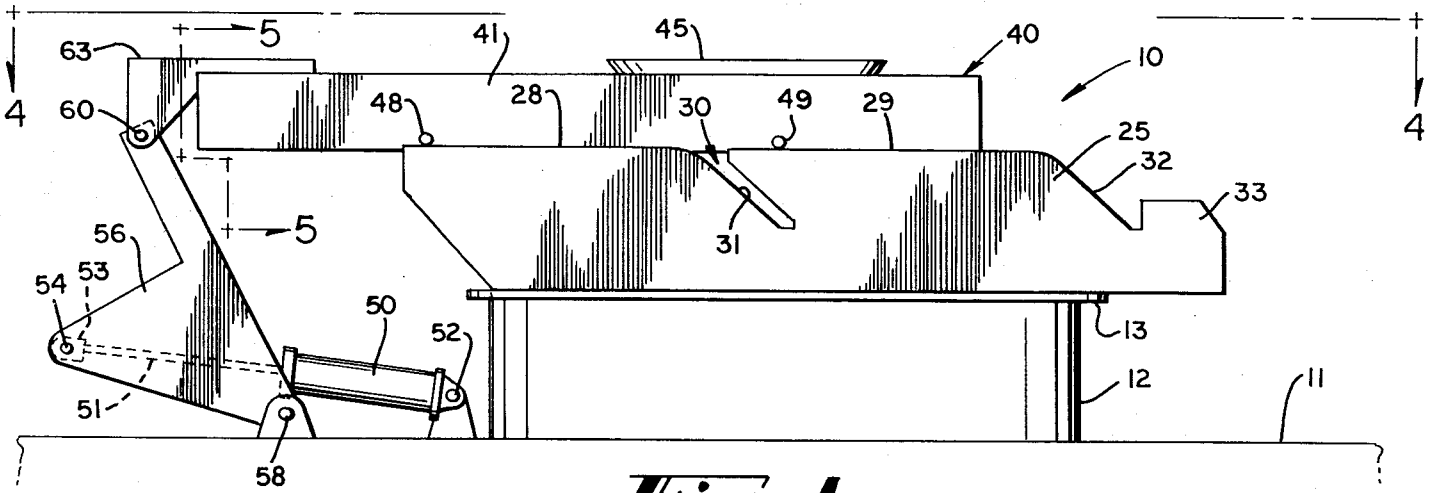
FIG. 1 is a side view of a gate closure apparatus embodying the present invention, mounted on the top of a storage bin, and shown in an open position.

Referring now in more detail to the drawing in which like numerals refer to like parts throughout the several views, FIG. 1 shows a side view of a gate closure apparatus 10 embodying the present invention, mounted on the top of a storage bin 11. The storage bin 11 includes a cylindrical neck portion 12 extending upwardly from the top of the storage bin 11, and a circular cover plate 13 defining an input opening 14 therein covering the neck 12. Although not shown or described herein, it will be understood by those skilled in the art that a revolving mechanism of a well known type can be mounted within the neck 12 of the storage bin 11 in order to evenly distribute material delivered into the storage bin 11 through the input opening 14.

Figure 3:
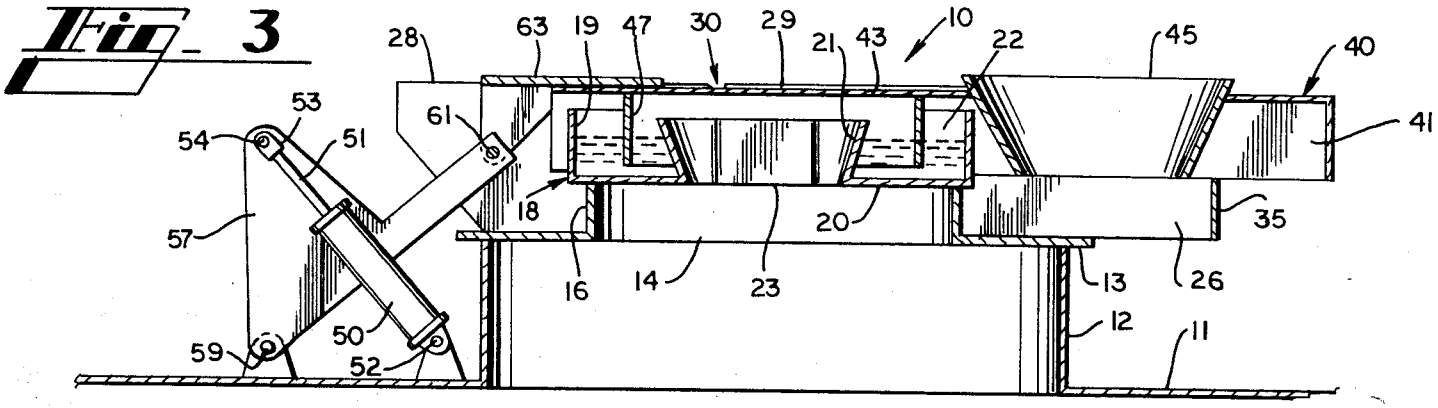
FIG. 3 is a view of the closure apparatus of FIG. 2, broken away to expose a vertical cross-section.
Figure 6:
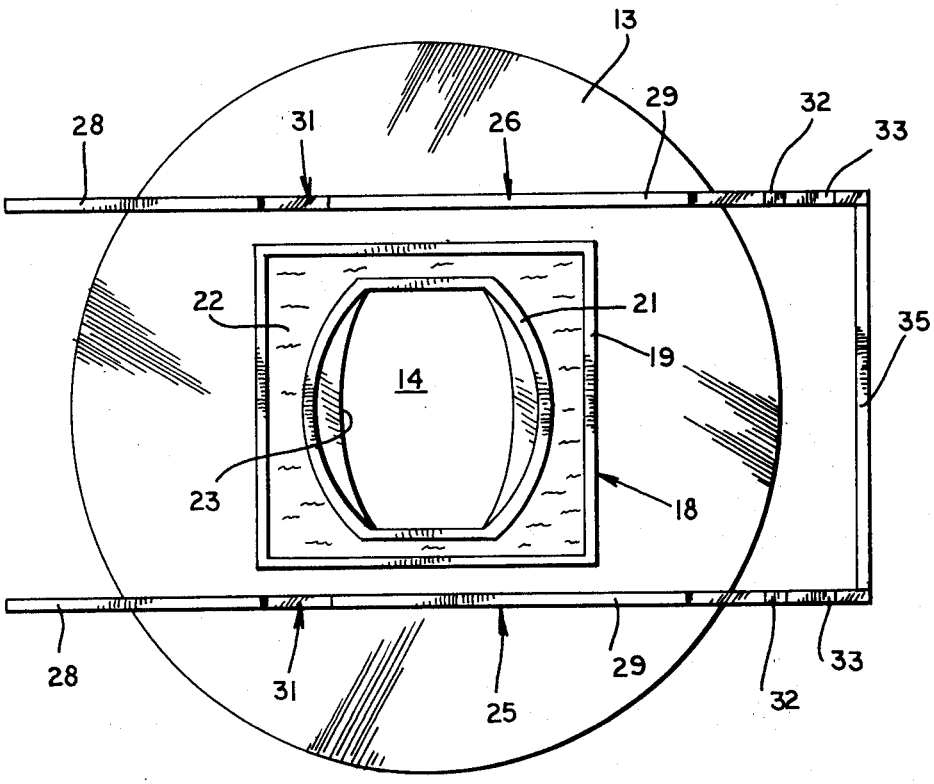
FIG. 6 is a top view of the reservoir and track apparatus, the gate having been removed therefrom.

The closure apparatus 10 is fixed to the top of cylindrical extension 16 of the neck 12, the extension 16 extending upwardly at the perpriphery of the input opening 14. A reservoir 18 is mounted to the top circular edge of the cylindrical extension 16. The reservoir 18 includes outer side walls 19 defining a rectangle supported by a bottom plate 20. An inner wall 21 extends upwardly from the bottom plate 20 and surrounds an opening 23 in the center of the bottom plate 20. A sealing liquid 22, such as oil, is held within the reservoir between the outer walls 19, the inner wall 21 and the bottom plate 20. The construction of the reservoir 18 is best shown in FIG. 3 and FIG. 6.

Mounted to the cover plate 13 on opposite sides of the reservoir 18 are a pair of parallel tracks 25 and 26. Each of the tracks 25 and 26 extend upwardly somewhat beyond the uppermost extent of the outer walls 19 of the reservoir 18. Each track includes a rear roller-engaging surface 28 and a forward roller-engaging surface 29 separated by a slot 30 inclined from the horizontal at approximately a 45° angle. Each slot 30 thereby provides an inclined roller-engaging surface 31 extending to a lowermost position that is below the surface of the liquid 22 in the reservoir 18. At the forward end of the forward roller-engaging surface 29, each of the tracks 25 and 26 includes a forward inclined roller-engaging surface 32 parallel to the rear inclined roller-engaging surface 31 and extending downwardly to the same level. A stop 33 is located at the bottom of each forward inclined roller-engaging surface 32. For support and rigidity, the two tracks 25 and 26 are connected at the forward ends thereof by a brace 35.

A carriage 40 is movably mounted on the tracks 25 and 26. The carriage 40 includes a rectangular frame 41 having a cover plate 43. In the forward portion of the carriage 40, a guide chute 45 is fixed in an opening in the cover plate 43. The chute 45 preferrably has a circular cross sectionand is funnel-shaped. At the rear portion of the carriage 40, connected walls 47 forming a rectangle extend downwardly from the bottom of the carriage cover plate 43. The shape of the rectangle formed by the walls 47 is such that the rectangle fits between the outer walls 19 and inner walls 21 of the reservoir 18. The walls 47 can therefore be lowered into the liquid 22 within the reservoir 18 in a manner to be described in detail hereinafter.

Figure 4:
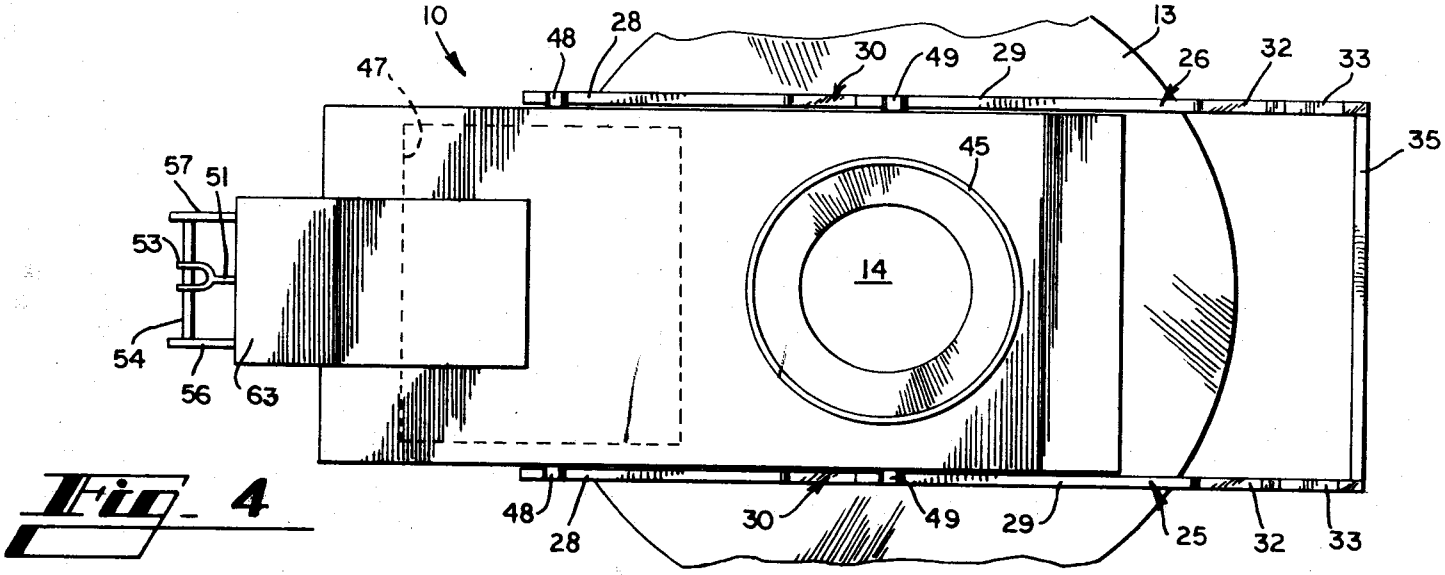
FIG. 4 is a top view of the closure apparatus shown in FIGS. 1 and 2, taken along line 4—4 of FIG. 1.
Figure 5:
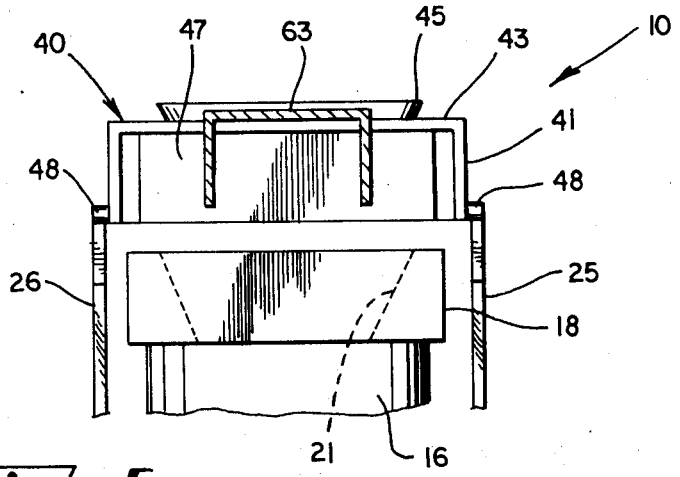
FIG. 5 is an end view of the closure apparatus of FIG. 1, taken along line 5—5 of FIG. 1.

Four rollers are mounted on the carriage 40 at the bottom edge of the frame 41, two rear rollers 48, one on each side of the frame 41, and two forward rollers 49, one on each side of the frame. The width of the frame 41 is such that the rear rollers 48 rest upon the rear roller-engaging surface 28 of the tracks 25 and 26, and the forward rollers 49 rest upon the forward roller-engaging surface 29, as shown in FIG. 4. The diameter of the rollers 48 and 49 is slightly less than the width of the slots 30, as shown in FIG. 2, so that the rollers can pass into the slots to lower the frame.

Figure 2:
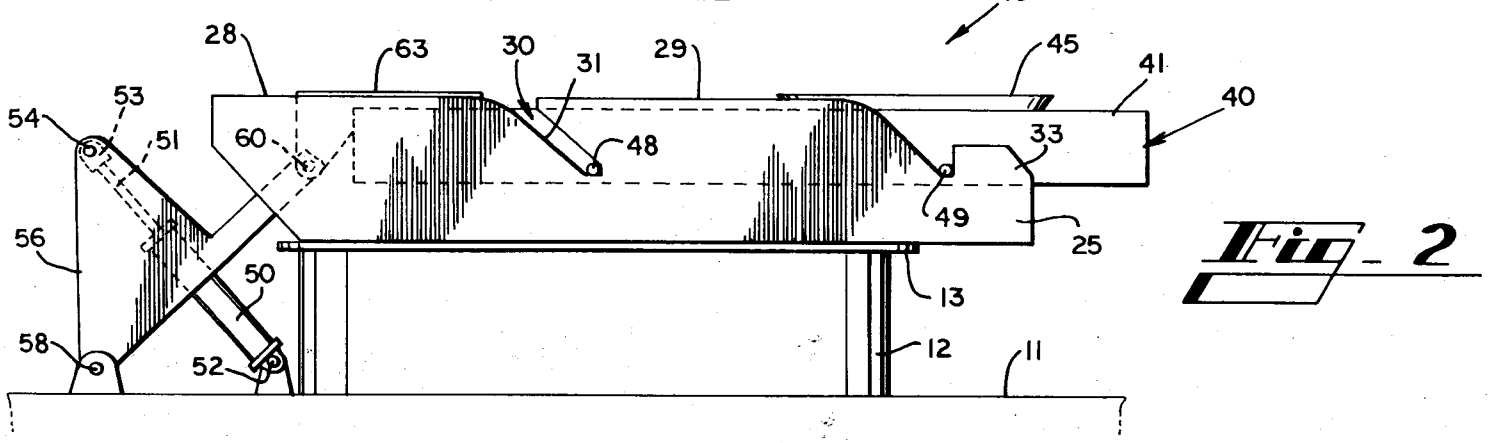
FIG. 2 is a side view of the closure apparatus shown in FIG. 1, shown in a closed position.

As shown in FIGS. 1-3 a hydraulic cylinder 50 is pivotally mounted at one end thereof to the top of the storage bin 11 at a pivot mount 52. The cylinder 50 is mounted adjacent to the rear end of the tracks 25 and 26. A piston rod 51 extends from the end of the cylinder 50 opposite the pivot mount 52, and is pivotally attached at the end thereof to an axle 54 by means of a pivot linkage 53. The ends of the horizontal axle 54 are attached to a pair of parallel lever arms 56 and 57. The lever arms 56 and 57 are pivotally mounted by means of a pair of lever pivot mounts 58 and 59 to the top of the storage bin 11, and are also pivotally attached at pivot joints 60 and 61 to a coupling member 63 that is rigidly attached to the rear end of the carriage 40. The connecting points of the lever arm 56, namely, 54, 58 and 60, are located at the vertices of a triangle with the axle 54 being located at the vertex that is in the most rearward position when the carriage 40 is in an open position, as shown in FIG. 1. Thus, as piston rod 51 is retracted into the cylinder, the lever arm 56 is rotated about the pivot mount 58 and exerts a horizontal force upon the carriage 40 at the pivot joint 60. The lever arm 57 is similarly mounted.

The operation of the closure gate apparatus 10 of the present invention will be described beginning with the apparatus in the open position as shown in FIG. 1. In this initial position, the piston rod 51 is extended out of the cylinder 50, and the carriage 40 is in its rearmost position, with the rollers 48 and 49 resting upon the rear roller-engaging surface 28 and the forward roller-engaging surfaces 29, respectively, of the tracks 25 and 26. In this initial position, the guide chute 45 is located directly over both the opening 23 in the bottom plate 20 of the reservoir 18 and the input opening 14 in the cover plate 13 of the storage bin 11. Material, such as asphalt aggregate material from a nearby manufacturing plant can be deposited into the funnel-shaped guide chute 45, and the material will be guided by the inner walls 21 of the reservoir 18 into the storage bin 11.

When it is desired to effect closure of the input opening 14 of the storage bin 11, a control (not shown) of the type well known to those skilled in the art for the hydraulic cylinder 50 is operated to withdraw the piston rod 51 into the cylinder 50. As the piston rod 51 enters the cylinder 50, the lever arms 56 and 57 are pivoted about the lever pivot mounts 58 and 59, causing the upper portion of the lever arms 56 and 57 at the pivot joints 60 and 61 to move forwardly with respect to the tracks 25 and 26. Since the coupling member 63 of the carriage 40 is attached to the lever arms 56 and 57 at the pivot joints 60 and 61, the carriage 40 moves forwardly on the rollers 48 and 49 which traverse the roller engaging surfaces 28 and 29 of each of the tracks 25 and 26. When the rollers 48 and 49 approach the inclined surfaces 31 and 32, the carriage 40 begins to be lowered along the inclined surfaces until the rearward rollers 48 reach the bottom of the slot 30, and the forward rollers 49 contact the stop 33. The lowering of the carriage 40 lowers the walls 47 diagonally into the liquid 22 contained in the reservoir 18. When the walls 47 are immersed in the liquid 22, the edges of an airtight box formed by the cover plate 43 and the walls 47 have been submerged in the liquid 22 surrounding the opening 23 leading into the otherwise airtight storage bin 11, to form a continuous liquid seal between the interior of the storage bin 11 and the outside atmosphere. The position of the lever arms 56 and 57 and of the cylinder 50 when the closure apparatus 10 is in its fully closed position are shown in FIGS. 2 and 3. In such closed position the chute 45 has been moved to a position laterally removed from the center of the input opening 14. It should be noted that it is not necessary to maintain fluid pressure in the hydraulic cylinder 50 when the storage bin 11 is closed in order to maintain the air tight connection provided by the apparatus. This is in contrast to prior systems which required constant application of pressure against a gasket to maintain an airtight seal.

Activation of the hydraulic cylinder 50 to once again extend the piston rod 51 results in a rearward force on the carriage 40 which rises up the inclined track surfaces 31 and 32, extracting the wall 47 from the reservoir 18. When the piston rod 51 is fully extended, the guide chute 45 is once again positioned directly over the opening 23 and the input opening 14 of the storage bin 11.

It will thus be seen that the closure apparatus 10 according to the present invention provides an efficient and uncomplicated means for providing an air tight seal for the opening in the top of a storage bin. Furthermore, the air tight seal provided by the present invention is more reliable than the seal provided by the solid or inflatable gaskets previously used in the art.

I claim:

1. A closure for an opening in the top of a storage bin comprising:

an annular reservoir surrounding said opening and containing a liquid;

a pair of parallel tracks on opposite sides of said reservoir;

a carriage mounted between said tracks over said opening for movement on rollers attached to said carriage along said tracks, said carriage including a guide means for guiding material to said opening and into said bin and a sealing means spaced apart from said guide means, said sealing means including a downwardly extending annular wall rigidly fixed to said carriage and shaped to be received within said annular reservoir;

said tracks defining a path along which said carriage travels on said rollers between two positions of said carriage, a first position wherein said guide means is aligned over said opening, and a second position lower than said first position wherein said annular wall extends into the liquid in said annular reservoir; and means for selectively moving said carriage along said tracks between said first position and said second position.

2. A storage bin having a removable sealing top closure, comprising:

a storage enclosure defining an upper surface thereof;

a neck portion extending upwardly from said upper surface of said storage enclosure;

an annular reservoir mounted on said neck portion and defining a central opening in communication with the interior of said storage enclosure through said neck portion, said reservoir containing a liquid;

a pair of parallel tracks mounted on said storage bin on opposite sides of said annular reservoir and spaced apart from said reservoir, said tracks each comprising an elongate, vertically extending plate, said plate defining therein a rear roller-receiving slot inclined, from a point centered with respect to said neck portion and reservoir and lower than the surface of liquid in said reservoir, upwardly and rearwardly to a horizontal rear roller-engaging surface defined by the upper edge of said plate and positioned above the uppermost extent of said reservoir, and a forward roller-engaging surface defined by the upper edge of said plate and extending horizontally and level with said rear roller-engaging from said rear roller-receiving slot forwardly for a distance equal to the length of said rear roller-engaging surface and then inclining downwardly parallel to said rear roller-receiving slot;

a carriage movable along said tracks, comprising a frame including a pair of parallel vertical side walls, a horizontal cover plate connecting said side walls, a downwardly extending annular wall mounted to the underside of a rear portion of said cover plate, said annular wall being shaped to be received within said annular reservoir, a passageway defined in a forward portion of said cover plate, and a plurality of rollers mounted on the side walls of said carriage, including a pair of rear rollers located adjacent to the midpoint of said annular wall on opposite sides of said carriage, for rolling motion along said rear roller-engaging surfaces, and a pair of forward rollers located adjacent to the midpoint of said passageway on opposite sides of said carriage for rolling motion along said forward roller-engaging surfaces;

a triangular lever arm pivotally connected at one of its vertices to the upper surface of said storage enclosure and at a second of its vertices to the rearward end of the carriage; and a hydraulic cylinder pivotally mounted to the upper surface of said storage enclosure between said neck portion and said pivotal connection of said lever arm to said upper surface, and including a selectively extendable piston rod pivotally attached to the third vertex of said triangular lever arm;

said carriage moving forwardly upon retraction of said piston rod, to cause said rollers to travel down said inclined rear roller-receiving slot and forward roller-engaging surface until said annular wall is inserted into the liquid in said annular reservoir, and said carriage moving rearwardly upon extension of said piston rod, to cause said annular wall to be withdrawn from said reservoir and said passageway to become aligned with the central opening defined by said reservoir.

* * * * *